US006211612B1

(12) United States Patent
Ge

(10) Patent No.: US 6,211,612 B1
(45) **Date of Patent: *Apr. 3, 2001**

(54) COLD CATHODE FLUORESCENT DISPLAY

(75) Inventor: Xiaoqin Ge, San Jose, CA (US)

(73) Assignee: GL Displays, Inc., Saratoga, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/183,763

(22) Filed: Oct. 30, 1998

Related U.S. Application Data

(63) Continuation of application No. 08/532,077, filed on Sep. 22, 1995, now Pat. No. 5,834,889.

(51) Int. Cl.[7] ..... H01J 17/00

(52) U.S. Cl. ..... 313/493; 313/573; 313/113; 313/317

(58) Field of Search ..... 313/493, 495, 313/113, 312, 317, 318.01, 318.12, 318.08, 573; 439/602, 611

(56) References Cited

U.S. PATENT DOCUMENTS

| | | |
|---|---|---|
| D. 334,242 | 3/1993 | Imamura et al. . |
| D. 334,990 | 4/1993 | Sekiguchi et al. . |
| 2,171,359 | 4/1939 | Gertler . |
| 4,029,984 | 6/1977 | Endriz . |
| 4,425,608 | 1/1984 | Hecker et al. . |
| 4,558,400 | 12/1985 | Buser . |
| 4,625,152 | 11/1986 | Nakai . |

FOREIGN PATENT DOCUMENTS

| | | |
|---|---|---|
| 1123945 | 6/1996 | (CN) . |
| 95116709 | 3/1997 | (CN) . |
| 0151850 | 8/1985 | (EP) . |
| 0213560 | 3/1987 | (EP) . |
| 0840953 | 5/1988 | (EP) . |
| 0331660 | 9/1989 | (EP) . |
| 0348979 | 1/1990 | (EP) . |
| 0593311 | 4/1994 | (EP) . |
| 1383653 | 2/1975 | (GB) . |
| 1485166 | 9/1977 | (GB) . |
| 2261332 | 5/1993 | (GB) . |
| 60-041750 | 3/1985 | (JP) . |
| 62-157657 | 7/1987 | (JP) . |
| 01315787 | 12/1989 | (JP) . |
| 03-264990 | 11/1991 | (JP) . |
| 7043680 | 2/1995 | (JP) . |
| 07-114904 | 5/1995 | (JP) . |
| 9092210 | 4/1997 | (JP) . |
| WO94/29895 | 12/1994 | (WO) . |
| WO9522835 | 8/1995 | (WO) . |
| 9738410 | 10/1997 | (WO) . |

OTHER PUBLICATIONS

"S11–3 Study to Improve the Flood–Beam CRT for Giant Screen Display," M. Morikawa et al., *Japan Display* '92, pp. 385–388; Dec. 1992.

"8.2: A High–Resolution High–Brightness Color Video Display for Outdoor Use," N. Shiramatsu et al., *SID 89 Digest*, pp. 102–105; Dec. 1989.

"28.5: Large Area Color Display Skypix," Y. Sakaguchi et al., *SID 91 Digest*, pp. 577–579; Dec. 1991.

*Primary Examiner*—Ashok Patel
(74) *Attorney, Agent, or Firm*—Majestic, Parsons, Siebert & Hsue P.C.

(57) ABSTRACT

A monochromic, multi-color and full-color cold cathode fluorescent display (CFD), comprises of some shaped white or multi-color or red, green blue color cold cathode fluorescent lamps (CCFL), reflector, base plate, temperature control means, luminance and contrast enhancement face plate, shades and its driving electronics. CFD is a large screen display device which has high luminance, high efficiency, long lifetime, high contrast and excellent color. CFD can be used for both outdoor and indoor applications even at direct sunlight, to display a character, or graphic and video image.

20 Claims, 8 Drawing Sheets

4,750,096 6/1988 Lim .
4,767,193 8/1988 Ota et al. .
4,839,564 6/1989 Ide et al. .
5,019,749 5/1991 Ito .
5,032,765 7/1991 Nilssen .
5,061,872 10/1991 Kukla .
5,191,259 3/1993 Hayashi et al. .
5,216,324 6/1993 Curtin .
5,220,249 6/1993 Tsukada .
5,337,068 8/1994 Stewart et al. .
5,387,837 2/1995 Roelevink et al. .
5,455,484 10/1995 Maya et al. .
5,457,312 10/1995 Mansour .
5,466,990 11/1995 Winsor .
5,502,626 3/1996 Armstrong et al. .
5,514,934 5/1996 Matsumoto et al. .

COLD CATHODE FLUORESCENT DISPLAY

This application is a continuation of Ser. No. 08/532,077 filed Sep. 22, 1995, U.S. Pat. No. 5,834,889.

BACKGROUND OF THE INVENTION

1. Field of the Invention

This invention relates in general to a cold cathode fluorescent display (CFD) and in particular, to a high luminance, high efficiency, long lifetime, monochrome or multi-color or full-color ultra-large screen display device, which can display character, graphic and video images for both indoor and outdoor applications.

2. Description of the Prior Art

The major prior technologies for ultra-large screen display are as follows:

A. Incandescent lamp display:

This display screen consists of a lot of incandescent lamps. The white lamps are always used for displaying a white and black character and graphic. The color incandescent lamps, which use red, green, and blue (R, G, B) color glass bubbles, are used for displaying multi-color or full-color character, graphic and image. An incandescent lamp display has been widely used for an outdoor character and graphic displays and possesses certain advantages such as high luminance, functionable at direct sunlight with shade and low cost of lamps. Nevertheless, this technology suffers from the following disadvantages: low luminous efficiency (i.e., white lamp about 10 lm/W; R, G, B<⅓ of white); high power consumption; poor reliability, unexpected lamp failure; short lifetime; expensive maintenance cost; long response time and is unsuitable for video-display.

B. LED:

LED has been widely used for indoor large screen and ultra-large screen displays, to display a multi-color and full-color character, graphic and video image. This display is able to generate high luminance for indoor applications and can maintain a long operation lifetime at indoor display luminance level. The disadvantages of LED, however, are as follows: low luminous efficiency and high power consumption especially for the ultra-large screen display; low luminance for outdoor applications especially when a wide viewing angle is required or at direct sunlight; is expensive, especially for an ultra-large screen display because of of the need of a lot of LEDs; and has a lower lifetime at a high luminance level.

C. CRT:

CRT includes Flood-Beam CRT (e.g., Japan Display '92, p. 285, 1992), and matrix flat CRT (e.g., Sony's Jumbotron as disclosed in U.S. Pat. No. 5,191,259) and Mitsubishi's matrix flat CRT (e.g., SID '89 Digest, p. 102, 1989). The CRT display is generally known for its ability to produce good color compatible with color CRT. The disadvantages of CRT are as follows: low luminance for outdoor applications; low contrast at high ambient illumination operating condition; short lifetime at high luminance operating condition; expensive display device due to complex structure and high anode voltage of about 10 kv.

D. Hot Cathode Fluorescent Display:

Hot cathode fluorescent technology has been used in a display system called "Skypix" (SID '91 Digest. p. 577, 1991) which is able to generate a high luminance of about 5000 cd/m$^2$ and can be operated at direct sunlight. The disadvantages of this system are: low luminous efficiency due to hot cathode and short gas discharge arc length; very high power consumption and short lifetime because of the hot cathode and too many switching times for video display.

At present, the incandescent lamps are commonly used for an outdoor character and graphic display.

The matrix flat CRT, including food beam CRT and matrix CRT, is the most common display for an outdoor video display. Neither of these two technologies presents a display system which can be used in both indoor and outdoor applications possessing unique features overcoming all or substantially all of the disadvantages described above.

SUMMARY OF THE INVENTION

The present invention has been made in view of the foregoing disadvantages of the prior art.

Accordingly, it is an object of the present invention to provide a very high luminance large screen and ultra-large screen display using a shaped cold cathode fluorescent lamp ("CCFL") with a special reflector and luminance enhancement face plate etc. It can be used for both indoor and outdoor applications even at direct sunlight. The dot luminance of the character and graphic display can be up to 15,000 cd/m$^2$ or more. The area average luminance of the full-color image can be up to 5000 cd/m$^2$ or more.

It is another object of the present invention to provide long lifetime large screen and ultra-large screen displays. The lifetime can be up to 20,000 hours or more at high luminance operating conditions.

It is one more object of the present invention to provide high luminous efficiency, low power consumption large screen and ultra-large screen displays. The luminance efficiency can be up to 30 lm/W or more.

It is a further object of the invention to provide a high contrast large screen and ultra-large screen display with the appropriate shades, black base plate and luminance and contrast enhancement face plate.

It is still a further object of the present invention to provide good temperature characteristics in large screen and ultra-large screen displays with a temperature control means. The CFD of the present invention can be used for both indoor and outdoor applications, and any ambient temperature condition.

In accordance with the present invention, a CFD is provided including some shaped R, G, B CCFLs, and R, G, B filters, reflectors, a base plate, a luminance and contrast enhancement face plate, a temperature control means, and its driving electronics to control the lighting period or lamp current or ON/OFF of CCFLs according to the image signal, and to control the luminance of CCFLs to display the character, graphic and image with monochrome, multi-color or full color.

BRIEF DESCRIPTION OF THE DRAWINGS

Other objects and many of the attendant advantages of the present invention will be readily appreciated as the same becomes better understood by reference to the following detailed description when considered in connection with the accompanying drawings, wherein:

FIG. 8(*b*) is a timing diagram to illustrate the operation of the circuit of FIG. 8(*a*).

FIG. 10(*b*) is a timing diagram to illustrate the operation of the circuit of FIG. 10(*a*).

FIG. 11(*b*) is a timing diagram to illustrate the operation of the circuit of FIG. 11(*a*).

DETAILED DESCRIPTION OF THE PREFERRED EMBODIMENTS

Now, a CFD according to the present invention will be described with reference to the accompanying drawings.

The CFD of the present invention has two types: CCFL assembly type and CCFL lamp type.

The CFD of the present invention can be a single piece structure or a mosaic structure. For the ultra-large screen CFD, it is always made in a mosaic type, i.e., the display screen is assembled by some mosaic tiles.

Figure 1B:
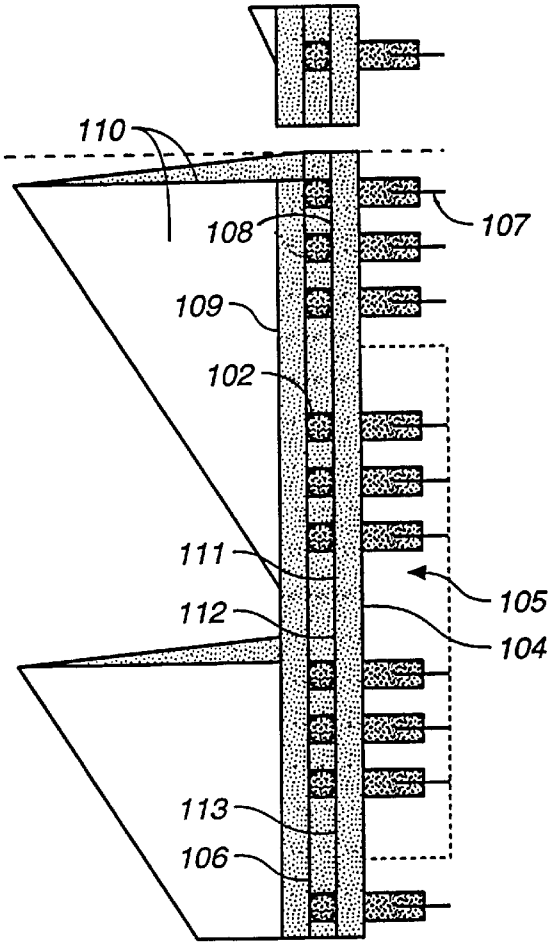
FIGS. 1(*a*) and 1(*b*) show a mosaic CCFL assembly type CFD with FIG. 1(*a*) being a partial top view of the mosaic CFD to illustrate the preferred embodiment of the invention and FIG. 1(*b*) being a partial side cross-sectional view of the device in FIG. 1(*a*).
Figure 1A:
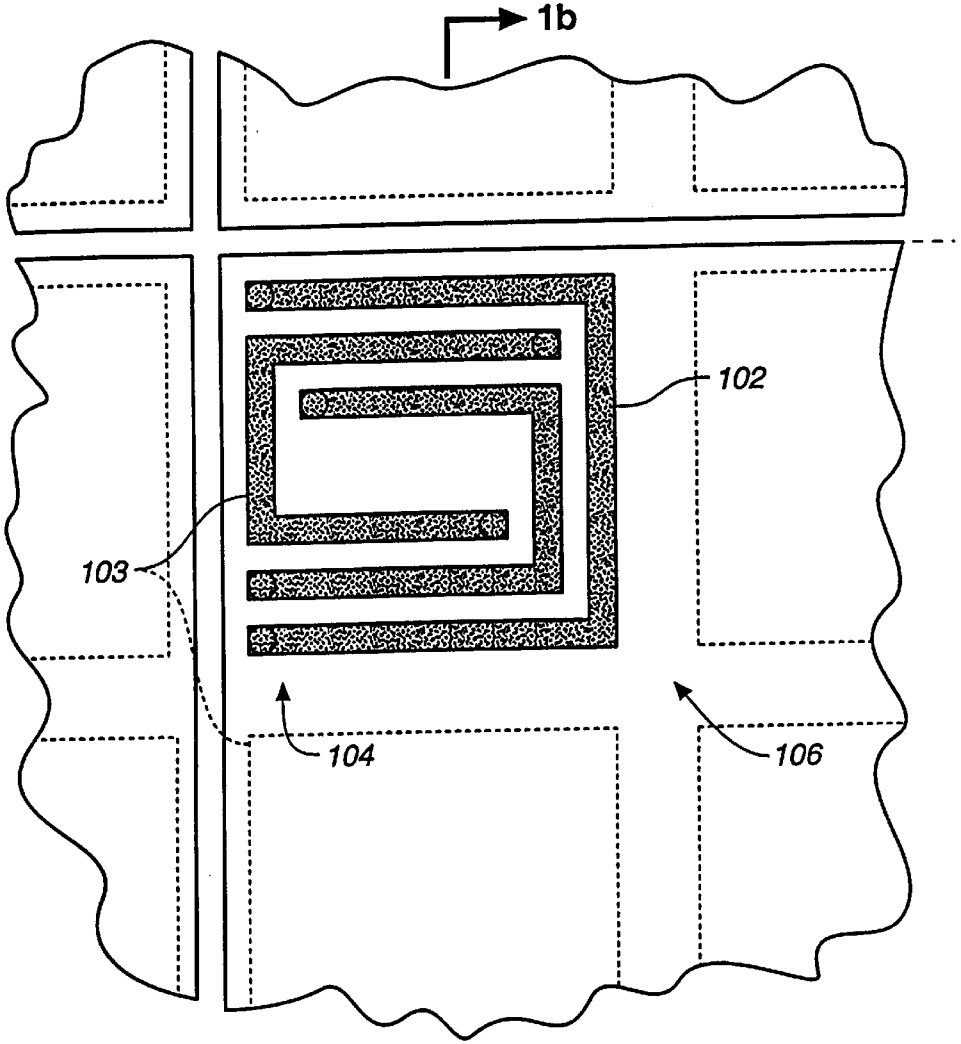

FIGS. 1(*a*) and 1(*b*) show a mosaic CCFL assembly type CDF wherein FIG. 1(*a*) shows a partial top view of a preferred embodiment of the mosaic CFD provided by the present invention and FIG. 1(*b*) further shows a partial side-view of FIG. 1(*a*). 101 is a partially sectional view of four (4) mosaic CFD tiles. The mosaic CFD tile includes shaped CCFLs 102, which can emit white or R, G and B light. FIG. 1(*a*) is an embodiment of R, G and B fill-color CFD. 103 is a pixel which comprises three shaped R, G and B color CCFLs. Generally, although not shown here, one or more pixels are combined together to form a module and one or more modules combined together to form a display screen to display full-color character, graphic and video image. The R, G and B color CCFLs may be respectively equipped with R, G and B filters whose functions are to absorb the variegated light emitted from gas discharge of the CCFLs to increase color purity, to improve the quality of the display images and to increase the contrast of the display image by absorbing the ambient incident light. Alternatively, the R, G and B CCFLs are made of R, G and B color glass tubes to absorb the variegated light emitted from gas discharge of CCFLs, to increase the color purity and to absorb the ambient incident light to increase the contrast of display image.

The shape of CCFL can be a "U" shape, serpentine shape, circular shape or other shapes. For the white or monochromic display, the pixels can be one shaped CCFL or two or more different color CCFLs. 104 is the base plate for the installation of the CCFLs 102, its driver 105 and other parts are described below. 106 is a black non-reflective surface between CCFLs 102 and the base plate 104 to absorb the ambient incident light and to increase the contrast of the display image. 107 are the electrode terminals of CCFLs 102, said electrode terminals 107 are bended towards the back of the base plate 104 and are connected to drivers 105. 108 is a reflector. 109 is a luminance and contrast enhancement face plate. 110 is the black shade to absorb the ambient incident light, including sunlight, to increase the contrast of the display image. 111 is a heating and temperature control means seated between CCFL 102 and base plate 104, and close to CCFL 102 to make the CCFL operating at an optimum temperature, e.g., 30° C. to 75° C., to guarantee the luminance and color uniformity of the display image and to get high luminance, high luminance efficiency, and to quickly start the display system at any ambient temperature. The heating and temperature control means 111 has a heat conductive plate 112. One mosaic tile may have one or several pieces of the heat conductive plate 112 to ensure that all CCFLs are operated at the same optimum temperature. Between the heating and temperature control means 111 and base plate 104, there is a heat preservation layer 113 to decrease the heat loss and to decrease the power consumption.

Figure 2:
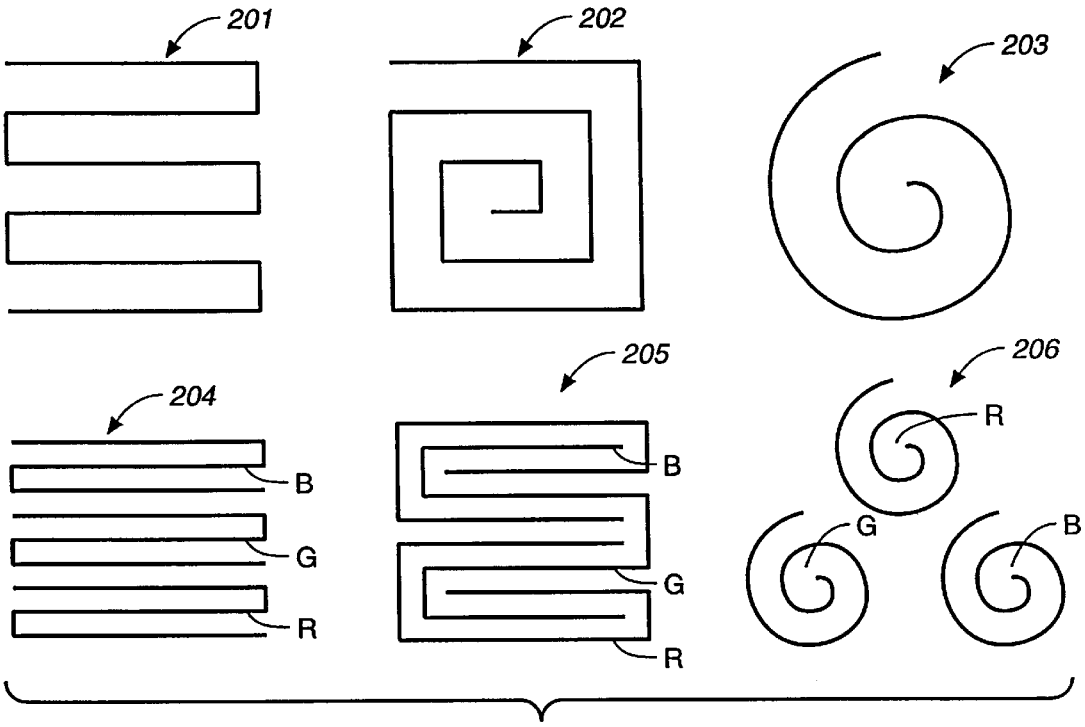
FIG. 2 shows some shape examples of CCFL.

FIG. 2 shows some examples of the possible shapes of the shaped CCFL 102. The shapes of 201, 202, and 203 are for the white or monochromic display, and 204, 205, and 206 are for multi-color and full-color displays.

Figure 3A:
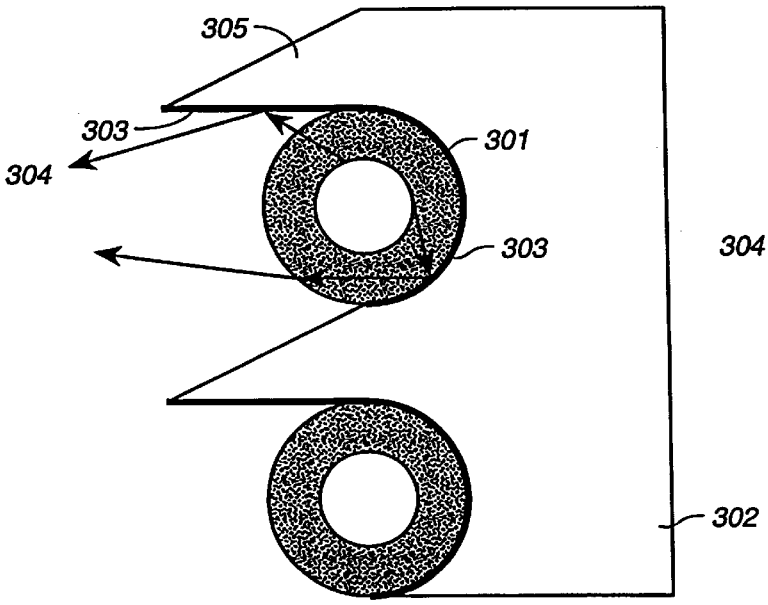
FIGS. 3(*a*) and 3(*b*) are partially cross-sectional views of two types of reflectors and the CCFLs.
Figure 3B:
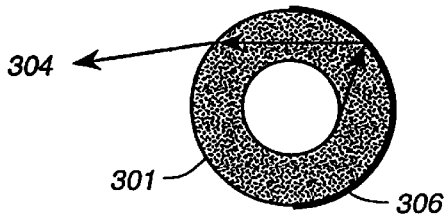

FIGS. 3(*a*) and (*b*) are the cross-sectional view of two kinds of reflectors and CCFL for the CCFL assembly type CFD as shown in FIG. 1. 301 is the CCFL. 302 is the base plate. 303 is the reflector which is made of high reflectance layer, e.g., Al or Ag or other alloy film,.or a high reflectance diffusing surface, e.g., white paint. The reflector 303 is used for reflecting the light emitted from the CCFL forward to viewers shown as 304. 305 are a plurality of small shades seated between CCFLs to absorb the ambient incident light to increase the contrast of the display image. In FIG. 3*b*, the reflector 306 is made of a high reflectance film, e.g., Al, Ag or alloy film, deposited on the back surface of the CCFL.

Figure 4:
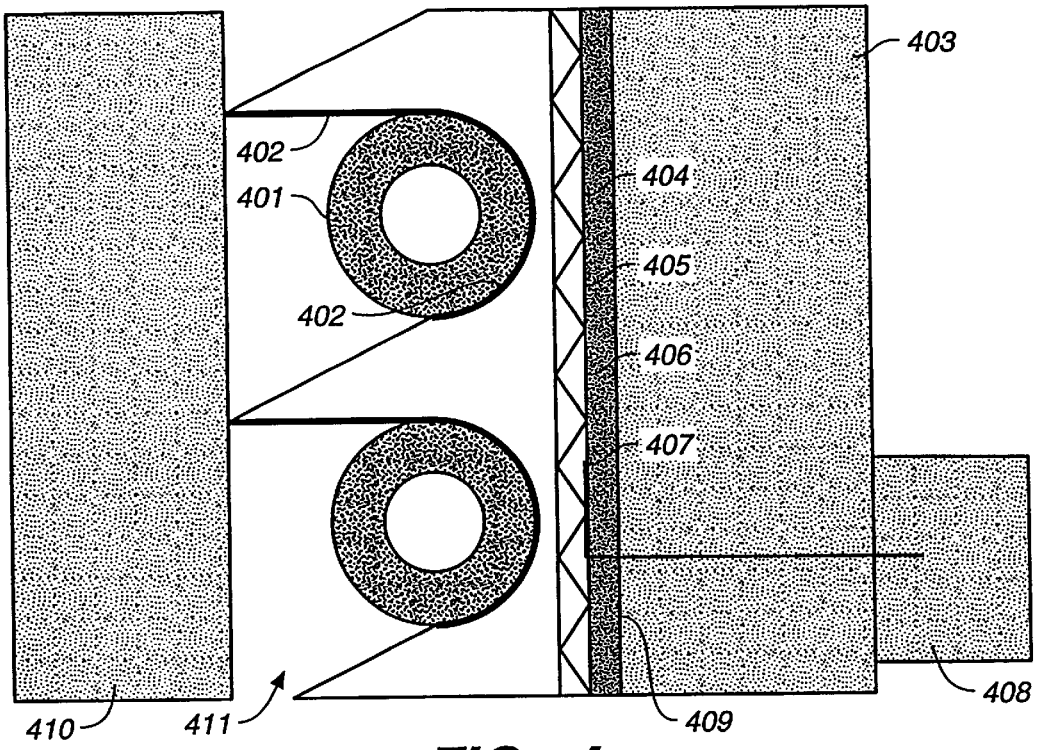
FIG. 4 is an embodiment of the heating and temperature control means.

FIG. 4 shows an embodiment of the heating and temperature control means. 401 is a CCFL. 402 is a reflector. 403 is the base plate. 404 is a heating means, e.g., it is made of an electric heating wire 405 or an electric heating film. 406 is a heat conductive plates and each mosaic tile has one or more heat conductive plate 106 to ensure that all CCFLs are operated at the same optimum temperature. 407 is a temperature sensor and 408 an automatic temperature control circuit. 409 is a heat insulating layer whose function is to decrease the heat loss and decrease the power consumption. 410 is a luminance and contrast enhancement face plate. The chamber between the face plate 410 and heat insulating layer 409 is a heat preservation chamber 411. The temperature of the chamber is controlled at an optimum operating temperature of CCFL, e.g., 30° C. to 75° C.

The said heating means 404 can simply be a heated air flow. The heat air flows through the whole screen between the face plate and the base plate. Some temperature sensors and control circuits are used to detect and control the temperature of the CCFL chamber.

Figure 5:
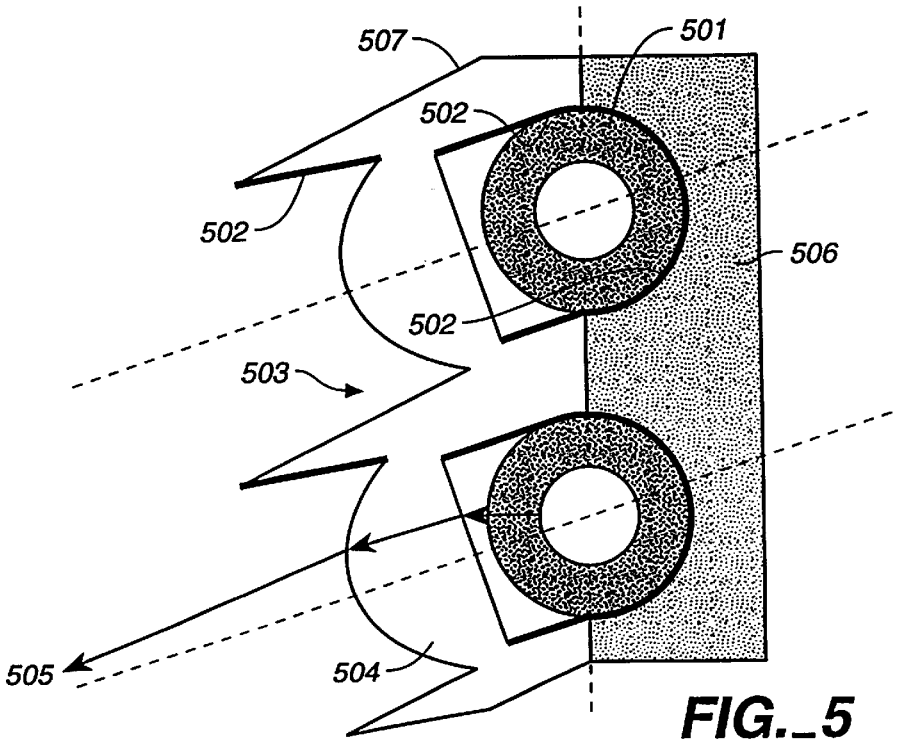
FIG. 5 is a cross-sectional view of an embodiment of the luminance and contrast enhancement face plate.

FIG. 5 is a cross-section view of an embodiment of the luminance and contrast enhancement face plate. 501 is the CCFL. 502 is the reflector. 503 is the luminance and contrast enhancement face plate, which consists of a cylinder lens or lens array 504 and the small shades 507. The optical axis of the lens is directed towards the viewers. The light emitted from the CCFL can effectively go through the reflector 502 and becomes focused on the lens 504 to a viewer 505 and thus, increase the luminance of the display image and the effective luminous efficiency. 506 is the base plate. 507 is a small shade seated at the top of the CCFL to absorb ambient incident light, including sunlight, to increase the contrast of the display image.

Figure 6:
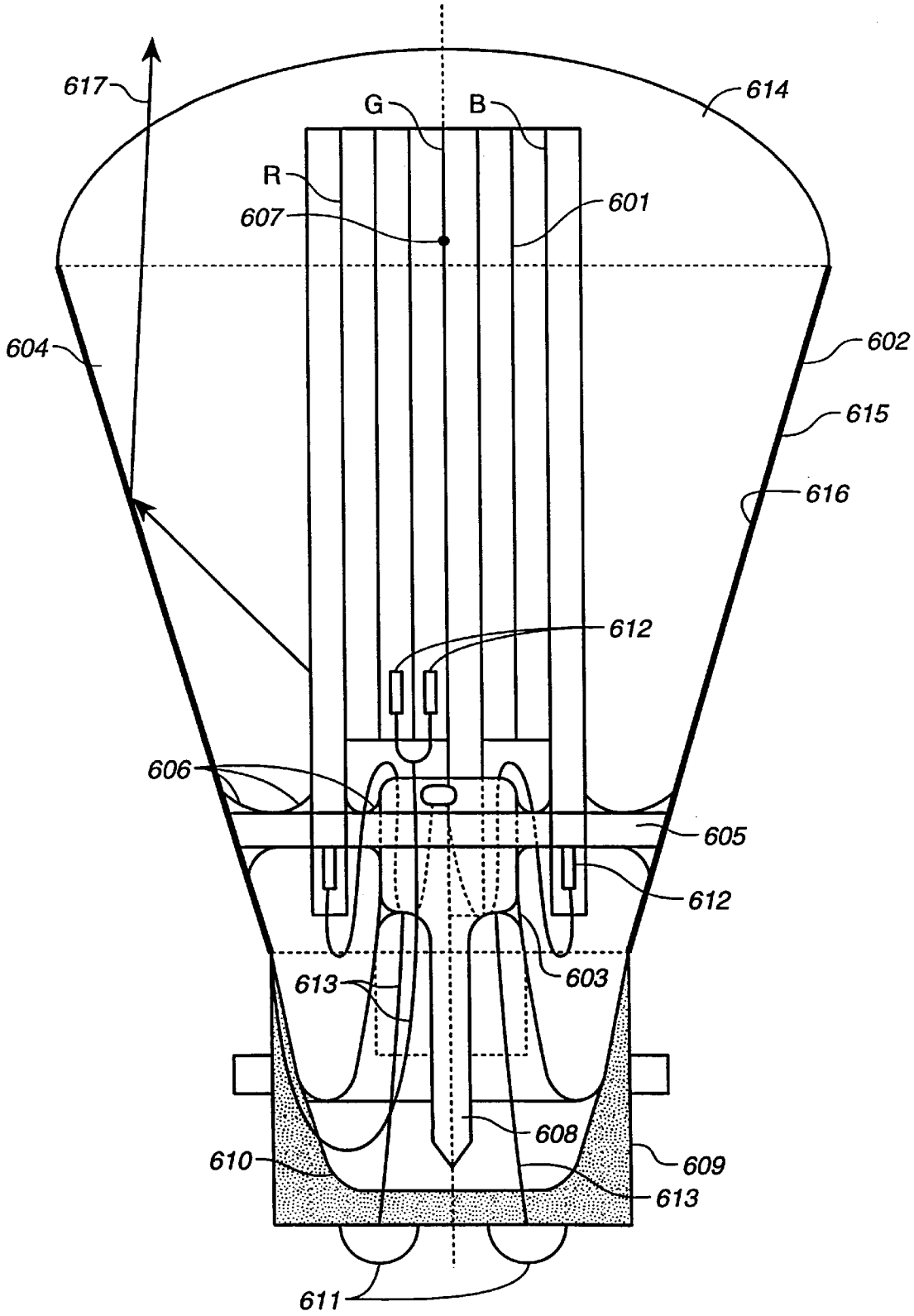
FIG. 6 shows the structure of a luminescent element of a CCFL lamp type CFD.

FIG. 6 shows luminescent elements of a CCFL lamp type CFD. 601 is the CCFL. For monochrome or white/black displays, 601 is at least one shaped white or monochrome CCFL. For the multi-color display, 601 is at least one group multi-color CCFL. For the full-color display, 601 is at least one group of R, G, B three color CCFL as shown in FIG. 6. 602 is a glass tube. 603 is a lamp base which is sealed within the glass tube 602 to form a vacuum chamber 604. 605 is a base plate on which the CCFLs are fixed. The base plate 605 is fixed on the lamp base 603 and its two ends are fixedly connected to the internal surface of the glass tube 602. To obtain a good fixing effect, a vacuum adhesive 606 such as ceramic adhesive is applied between/among the base plate 605, the lamp base 603 and the CCFLs. If the CCFL is more than one piece between the CCFLs, these CCFLs are also fixed to each other by an vacuum adhesive 607. 608 is an exhaustion tube for exhausting the gas in the chamber 604. 609 is a lamp head which is fixed to the lamp base by a fixing adhesive 610. 611 are connectors of the lamp. 612 are electrodes of the CCFLs which are connected to the connector 611 and the lamp head 609 through leads 613. The glass tube 602 can be a diffusing glass tube to obtain a diffusing light. Alternatively, the glass tube 602 as shown in FIG. 6, the glass tube 602 has a front face 614 and a backside 615. The front face 614 is a transparent or a diffusing spherical surface and the backside 615 is a cone shape or a near cone shape tube. On the internal surface of the backside 615 of the glass tube, there is a reflective film 616, e.g., an Al, Ag, or alloy thin film, to reflect the light and to increase the luminance of the lamp shown as 617. The vacuum chamber 604 can reduce the heat loss of the CCFL and hence increase the efficiency of the CCFL. In addition, the vacuum chamber 604 can also eliminate any undesirable effects caused by the ambient temperature to the characteristics of the CCFL. The base plate 605 is a high reflective plate to reflect the light and to increase the luminance of the CFD. Some of the CCFL lamps shown in FIG. 6 can be used for making the monochromic, multi-color, full-color display system to display a character, graphic or video images. The CCFL lamps can also be used for the purposes of illumination.

Figure 7:
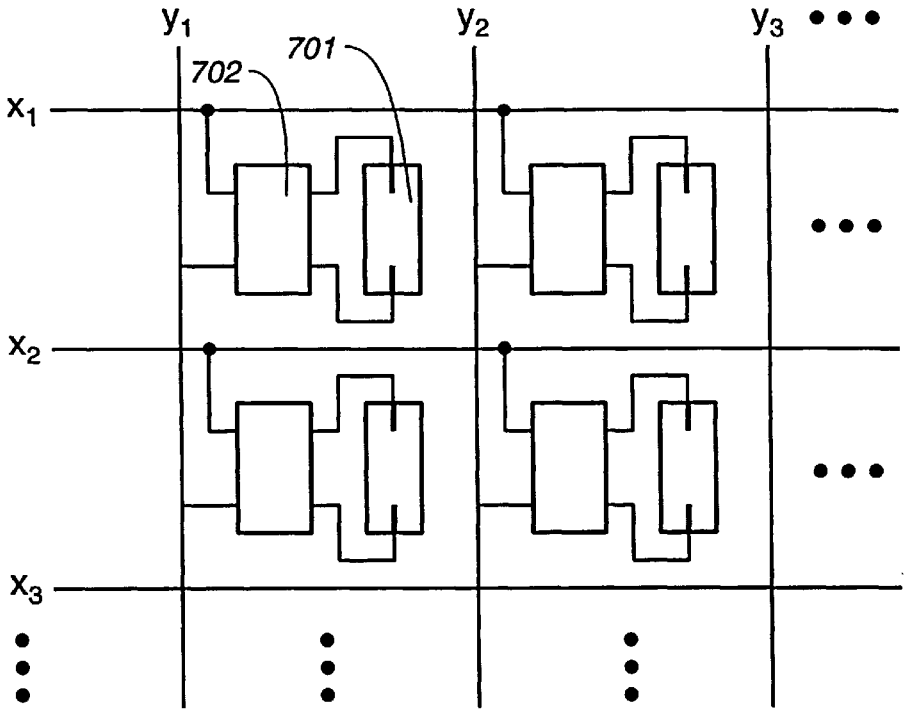
FIG. 7 is a schematic driving circuit diagram of CFD.

Referring now to FIG. 7, the driving circuit of CFD is schematically diagramed. 701 are the CCFLs. 702 are DC/AC converters which change the DC input voltage to a high voltage and high frequency (e.g., tens kHz,) AC voltage to drive the CCFL. The symbols $x_1$, $x_2$ . . . are scanning lines. The symbols $y_1$, $y_2$ . . . are column data electrodes. One DC/AC converter 702 drive one CCFL 701. To control the period of input voltage of the DC/AC converter 702 according to an image signal, the luminance of the CCFL can be controlled and the character, graphic and the image can be displayed.

Figure 8A:
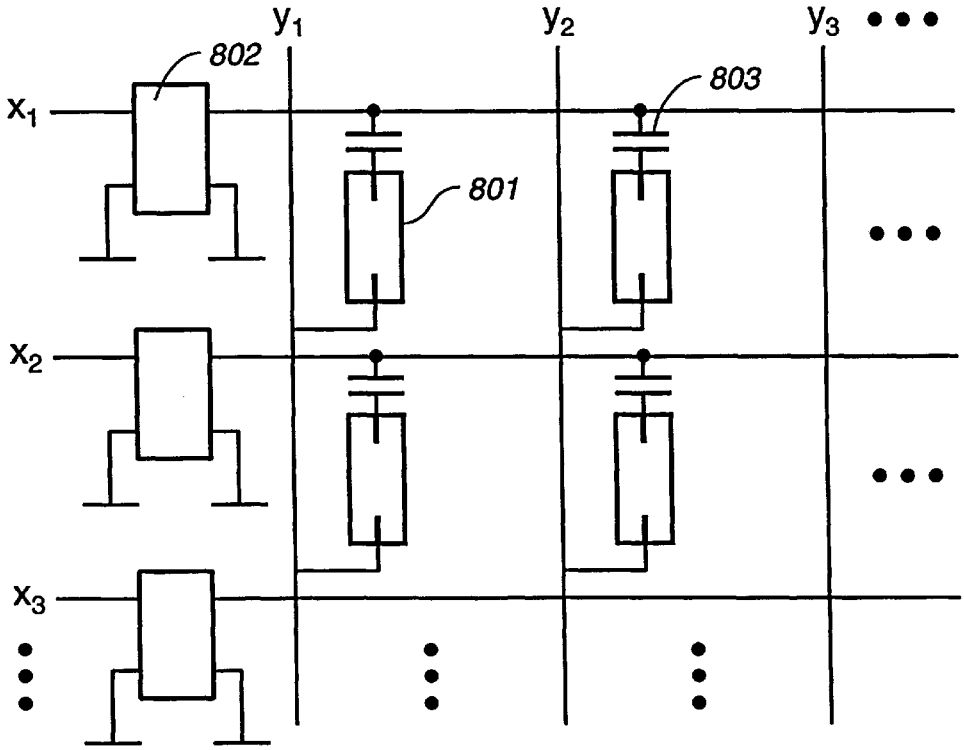
FIG. 8(*a*) is another schematic driving circuit diagram of CFD.
Figure 8B:
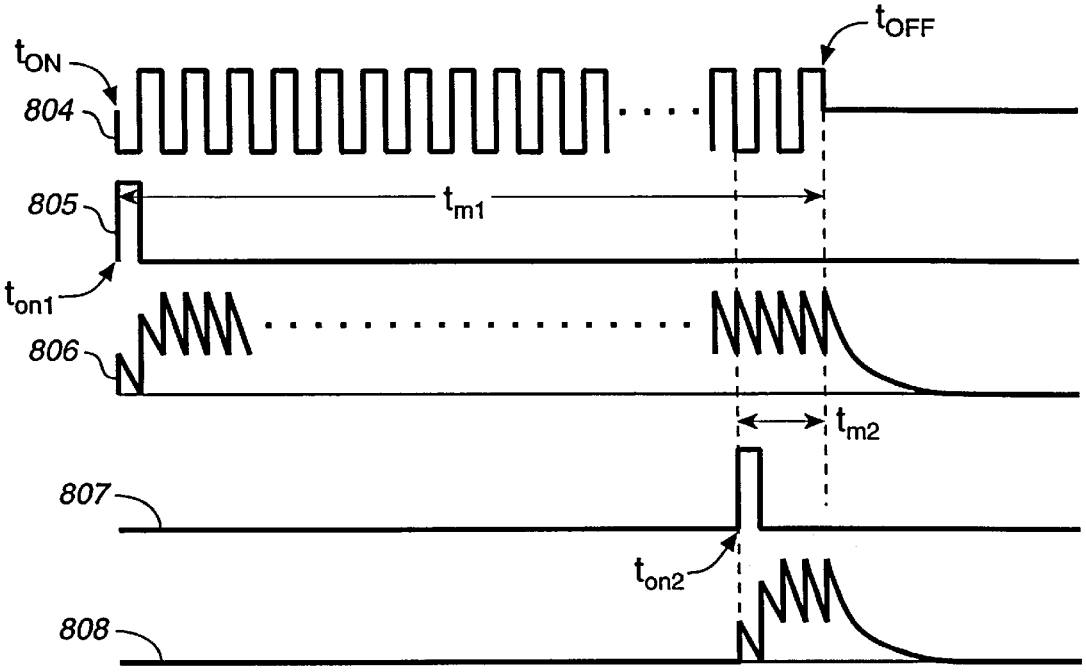

The CFD as illustrated in FIG. 7 will need a lot of DC/AC converters to drive its CCFLs. In order to reduce the number of DC/AC converters and to reduce the cost of the display system, a method which uses one DC/AC converter driving one line of CCFL or one group of CCFL can be adopted as shown in FIG. 8(*a*). FIG. 8(*b*) is a timing diagram to further illustrate the operation of the circuit of FIG. 8(*a*). 801 are the CCFLs. 802 are the DC/AC converters. 803 are coupled capacitors. The symbols $x_1$, $x_2$ . . . are scanning lines. The symbols $y_1$, $y_2$ . . . are column data electrodes. When one scanning line, e.g., $x_1$, is addressed (FIG. 8*a*, $t_{ON}$), the related DC/AC converter is turned ON to output a sustained AC voltage shown as 804. This sustained voltage is lower than the starting voltage of the CCFL, and cannot start the CCFLs of this line, but can sustain lighting after CCFL started. Because the starting voltage of CCFL is much larger than the sustained voltage, when the column date electrode ($y_1$, $y_2$, . . ) is at 0 v, the related CCFL cannot be started and will stay at the OFF state. When the column date electrode supplies an anti-phase trigger voltage, the related CCFL will be started. The CCFL will light until the related DC/AC converter is turned OFF as shown in FIG. 8(*b*) as $t_{OFF}$. The lighting period $t_m$ according to the image signal can be controlled to modulate the luminance of CCFL and to display character, graphic, and image with monochrome or multi-color or full-color. For example, 805 is for a high luminance 806, the lighting period is $t_{m1}$, ($=t_{OFF}-t_{on1}$), and 807 is for a lower luminance 808, the lighting period is $t_{m2}$ ($-t_{OFF}-t_{on2}$) and so on.

Figure 9:
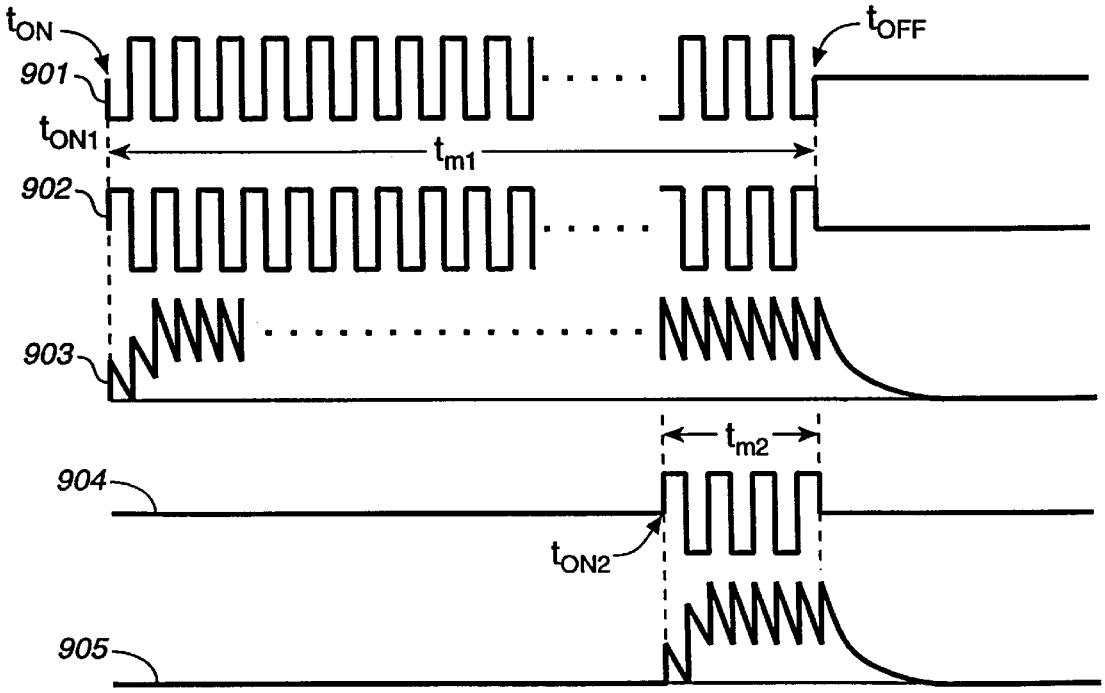
FIG. 9 is a timing diagram to illustrate another operating method of the circuit of FIG. 8(*a*).

FIG. 9 shows a different operating method than the circuit shown in FIG. 8*a*. 901 is the same as 804 as shown in FIG. 8(*b*) for line scanning. 902 and 904 are column data voltage, which have an anti-phase with the scanning voltage 901. When a CCFL is applied to the scanning voltage 901 and the signal voltage 902 at the same time, the total voltage applied to the CCFL will be larger than the starting voltage of the CCFL which will light the CCFL in this period. The ON time $t_{m1}$ and $t_{m2}$, i.e., lighting period, depend on image signals. Different $t_m$ have different lighting periods shown as 903 and 905, i.e., different luminance, to display a character, graphic and image.

Figure 10A:
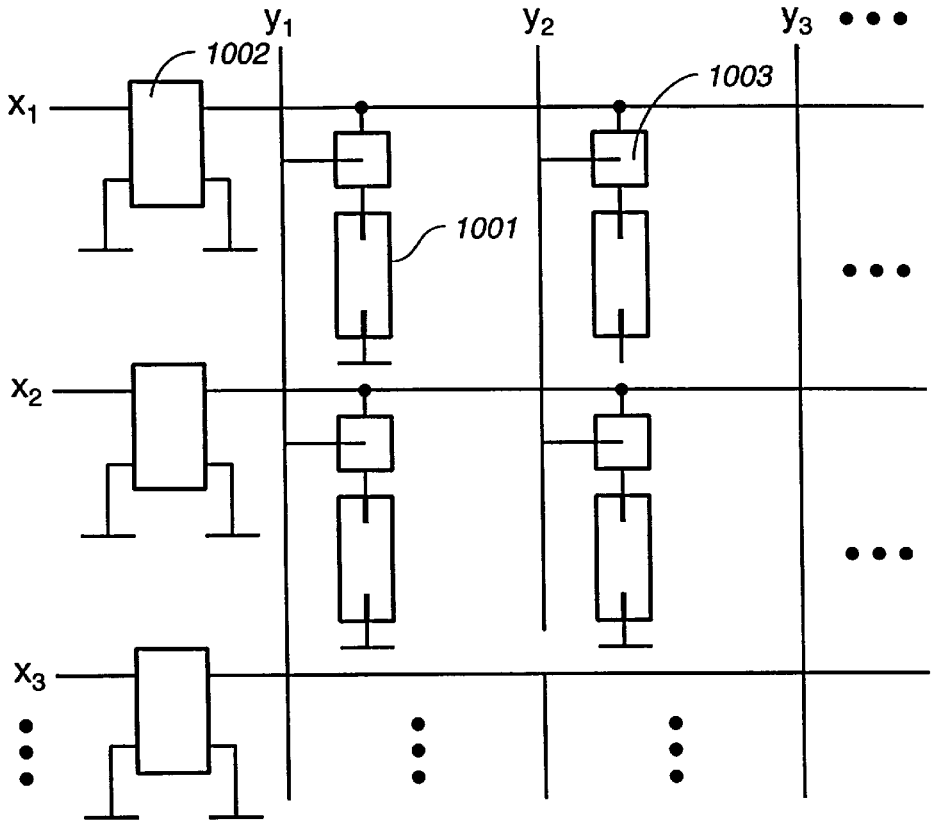
FIG. 10(*a*) is an alternative schematic driving circuit diagram of CFD.
Figure 10B:
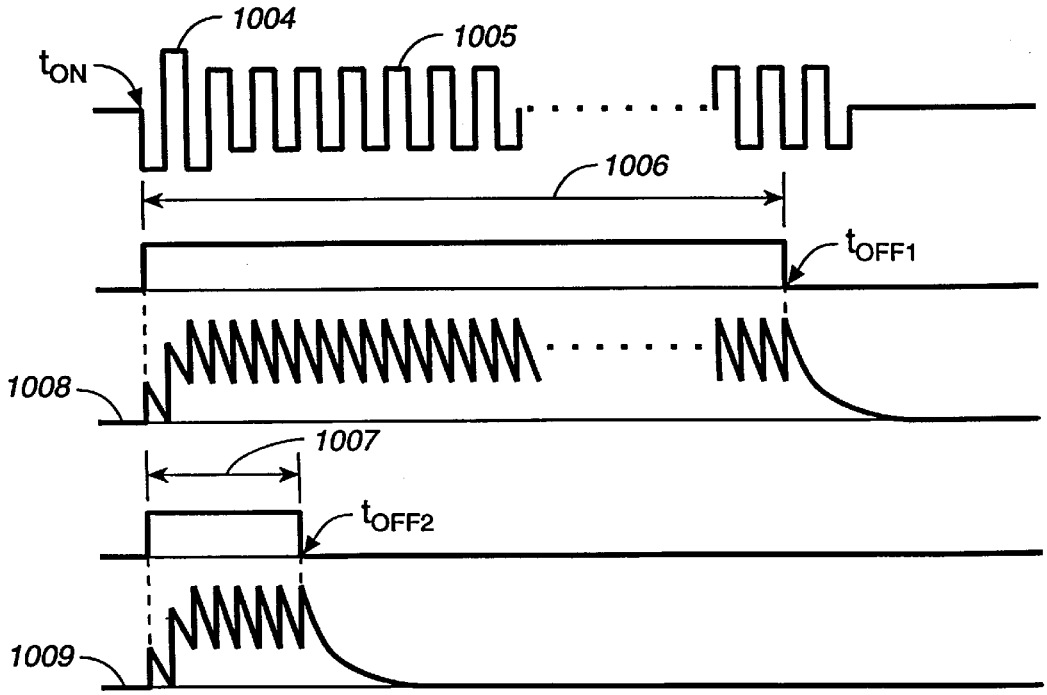

FIG. 10(*a*) is yet another schematic diagram for the driving circuit of CFD. The symbols $x_1$, $x_2$ . . . are the scanning lines. The symbols $y_1$, $y_2$ . . . are the column data electrodes. 1001 are the CCFLs. 1002 are the DC/AC converters. 1003 are AC voltage switches. One line of the CCFL or one group of CCFLs has one DC/AC converter 1002. When the switch 1003 is turned ON according to the image signal, the related CCFL will be lighted, and the character, graphic and image can be displayed. In this case, because the starting voltage of CCFL is larger than the sustained voltage, all CCFLs in the same line or same group should start at the same time as shown in FIG. 10(*b*) as $t_{On}$. At this time, the related DC/AC converter will be turned ON to output a larger voltage 1004, which can start the CCFL. Consequently, all the CCFLs connected with this DC/AC converter are started at this time if the related switch is turned ON. After the CCFL started, the DC/AC converter will output a lower sustained voltage 1005 to sustain the CCFL lighting. The turned OFF time $t_{OFF}$, e.g., $T_{off1}$, and $T_{off2}$, can obtain a different lighting period, e.g., 1006 and 1007, different luminance 1008 and 1009 can be obtained to display the character, graphic and image.

Figure 11A:
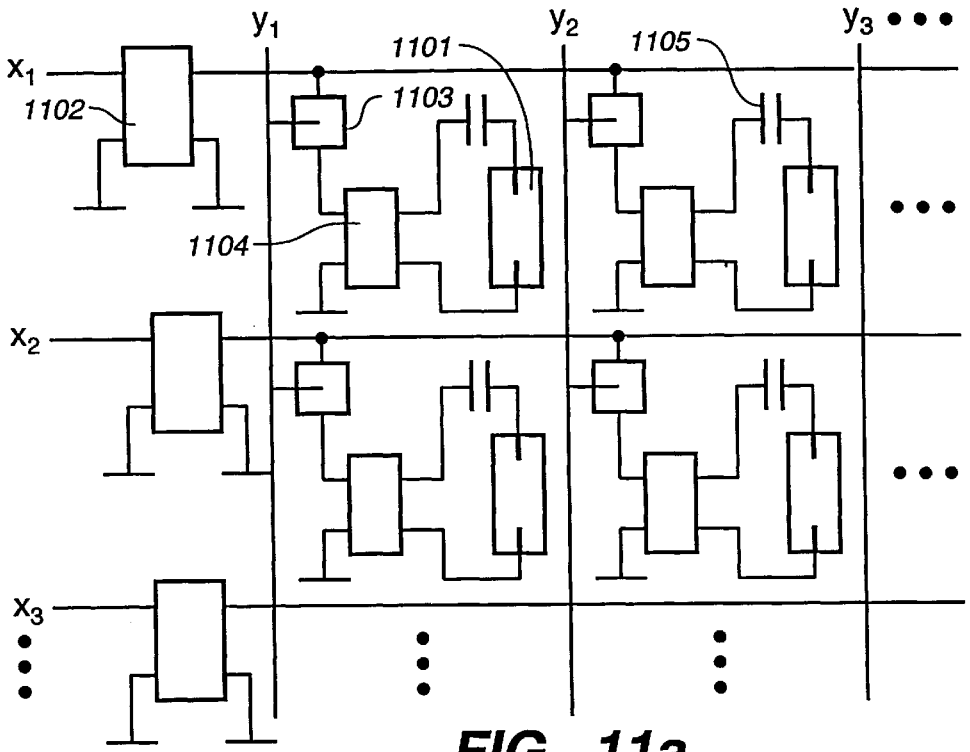
FIG. 11(*a*) is a different schematic driving circuit diagram of CFD.
Figure 11B:
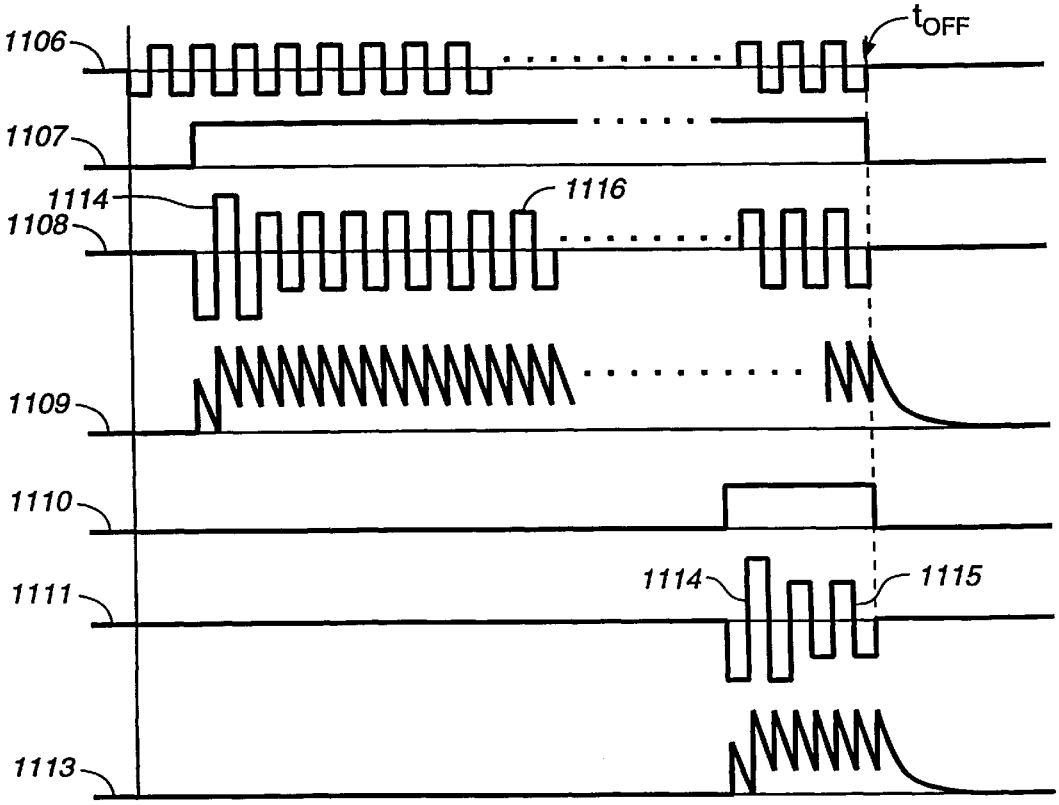

FIG. 11(*a*) shows a low AC voltage switch driving circuit. The symbols $x_1$, $x_2$ . . . are scanning lines. The symbols $y_1$, $y_2$ . . . are column data electrodes. 1101 are the CCFLs. 1102 are DC/AC converters, which outputs a low AC voltage, e.g., several to ten volts and tens kHz. One line of CCFL or one group of CCFLs has one DC/AC converter. 1103 are low AC voltage switches. 1104 are transformers from which the low AC voltage can be changed to a high AC voltage. 1105 are coupling capacitors. The driving timing diagram is shown in FIG. 11(*b*). 1106 is the low AC voltage output from the DC/AC converter when the line is addressed. 1107 and 1110 are the AC switch control voltages, their widths are dependent on the image signals. 1108 and 1111 are the high AC voltage output transformers. 1109 and 1113 are the light waveforms emitted from the CCFLS. When an AC switch is turned ON, the related transformer will output a higher voltage 1114 to starting the related CCFL. After the CCFL is started, the transformer output a lower sustained voltage 1115 to sustain the CCFL lighting. When the DC/AC converter 1102 is turned OFF, shown as $t_{OFF}$, all the addressed CCFLs are turned OFF. To control the ON time of the AC switch according to an image signal, the luminance of the CCFL can be modulated to display the character, graphic and image.

What is claimed is:

1. A fluorescent display device comprising;

at least one cold cathode fluorescent lamp having at least one electrode;

a glass tube defining a vacuum chamber therein housing said at least one lamp so as to reduce heat loss, to increase the luminous efficiency and to eliminate the effect of the ambient temperature on the at least one fluorescent lamp; and a support member connected to the tube supporting the at least one lamp.

2. The device of claim 1, wherein said glass tube has a front face which includes a diffusing spherical portion.

3. The device of claim 1, wherein the glass tube has a front face with a transparent spherical surface and a cone-shaped or near cone-shaped backside and a high reflective layer on or near the backside to reflect light and to increase the luminance of the device.

4. The device of claim 3, wherein the layer is a thin film comprising an Al, Ag or alloy on an internal surface of said tube.

5. The device of claim 1, said at least one cold cathode fluorescent lamp emits substantially monochromatic light.

6. The device of claim 1, said device comprising at least one group of red, green and blue lamps in the tube.

7. The device of claim 1, said support member comprising a high reflectance base plate to reflect light from the at least one lamp and to increase the luminance of the device.

8. The device of claim 1, said support member comprising a base plate supporting the at least one lamp, said device further comprising:

a lamp base attaching the at least one lamps to said base plate; and a connector connected to the at least one electrode.

9. A cold cathode gas discharge apparatus, comprising:

at least one cold cathode fluorescent lamp; and a light transmitting container housing said at least one lamp; and a support member connected to the container and supporting the at least one lamp.

10. The apparatus of claim 9, said container being a glass tube.

11. The apparatus of claim 9, further comprising means for controlling temperature of the lamp.

12. The apparatus of claim 11, said temperature controlling means controlling the temperature of the lamp to within a range of 30 to 75 degrees Celsius.

13. The apparatus of claim 11, said temperature controlling means comprising a heating element, a temperature sensor, an automatic control circuit and a heat conductive plate.

14. The apparatus of claim 13, said apparatus comprising a plurality of cold cathode fluorescent lamps adjacent to said heat conductive plate, said heating element comprising an electrical heating wire or film, said heat conductive plate including aluminum or an alloy, wherein the heating element is seated on the heat conductive plate to keep the lamps at the same temperature.

15. The apparatus of claim 9, said support member being a base plate.

16. The apparatus of claim 15, said base plate attached to an inner wall of the container, so that substantially all of the at least one lamp is housed within the container.

17. The apparatus of claim 9, wherein said at least one lamp is "U" shaped, or has a serpentine or spiral shape.

18. The apparatus of claim 9, said member being a base plate, said apparatus further comprising:

an array of cold cathode fluorescent lamps adjacent to said base plate; and reflecting means at or near the base plate to reflect light emitted by the lamps.

19. The apparatus of claim 9, said member being a base plate, said apparatus further comprising:

an array of cold cathode fluorescent lamps adjacent to said base plate; and an array of lenses focusing light emitted by the lamps.

20. The apparatus of claim 9, said member being a base plate, said apparatus further comprising:

an array of cold cathode fluorescent lamps adjacent to said base plate; and an array of shades above the lamps to shield the lamps from sunlight.

* * * * *